United States Patent [19]

Dieterich, Jr.

[11] Patent Number: 5,029,926

[45] Date of Patent: Jul. 9, 1991

[54] HANDLE FOR PLASTIC BAG

[76] Inventor: Peter D. Dieterich, Jr., 88c Belvedere, San Rafael, Calif. 94901

[21] Appl. No.: 399,763

[22] Filed: Aug. 28, 1989

[51] Int. Cl.[5] ..... A45C 13/26; B65D 33/06

[52] U.S. Cl. ..... 294/171; 16/114 B; 383/13

[58] Field of Search ..... 294/137, 166, 170, 171; 16/114 R, 114 B; 220/94 R, 96; 229/117.19, 117.23–117.25; 383/6, 12, 13, 23, 25, 26, 29; 493/226

[56] References Cited

U.S. PATENT DOCUMENTS

| | | | |
|---|---|---|---|
| 645,670 | 3/1900 | Ottignon | 294/171 |
| 743,945 | 11/1903 | Soden | 294/171 |
| 1,000,118 | 8/1911 | Pope | 294/170 |
| 1,226,403 | 5/1917 | Snyder . | |
| 1,268,775 | 6/1918 | Stanger | 294/171 |
| 1,576,546 | 3/1926 | Ransom | 294/171 |
| 1,618,854 | 2/1927 | Worth . | |
| 2,287,329 | 6/1942 | Santa Maria et al. . | |
| 2,506,781 | 5/1950 | Elliott | 294/171 |
| 2,634,797 | 7/1954 | Schulte . | |
| 2,717,411 | 9/1955 | Taipale . | |
| 3,083,366 | 3/1963 | Franges | 294/171 |
| 3,149,367 | 9/1964 | Dills . | |
| 3,800,361 | 4/1974 | Stauffer . | |
| 4,590,640 | 5/1986 | Enersen . | |
| 4,841,596 | 6/1989 | Fink | 294/170 X |
| 4,902,060 | 2/1990 | Nobakht | 294/171 |
| 4,923,235 | 5/1990 | Stewart | 294/171 X |
| 4,936,619 | 6/1990 | Salazar | 294/171 |

FOREIGN PATENT DOCUMENTS

| | | | |
|---|---|---|---|
| 85524 | 8/1983 | European Pat. Off. | 294/171 |
| 1235049 | 5/1960 | France | 294/171 |
| 761947 | 11/1956 | United Kingdom | 294/171 |
| 2113081 | 8/1983 | United Kingdom | 294/171 |
| 2135179 | 8/1984 | United Kingdom | 294/171 |
| 2147800 | 5/1985 | United Kingdom | 294/171 |

*Primary Examiner*—Johnny D. Cherry

*Attorney, Agent, or Firm*—Flehr, Hohbach, Test, Albritton & Herbert

[57] ABSTRACT

An attachable bag holder for use with a bag having at least one carrying loop. The holder includes an elongated body terminating in opposed ends and formed with a loop receiving channel on an upwardly facing side and a manually engageable gripping surface on a downwardly facing side of the holder body. A retention structure formed for easy insertion and yet difficult removal or trapping of the bag loops in the holder upon attachment of the same is provided. The holder body is preferably formed with the U-shaped cross section which permits nesting of holders in a stacked relation. The manually engageable gripping surface is downwardly convexed and formed with finger indentations to transfer loading forces to each of the fingers on the user's hand, and provide a firm positive grip which combine to reduce fatigue. The gripping surface configuration also provides transverse, as well as longitudinal, rigidity to the holder. A holder dispenser and method are also disclosed.

20 Claims, 4 Drawing Sheets

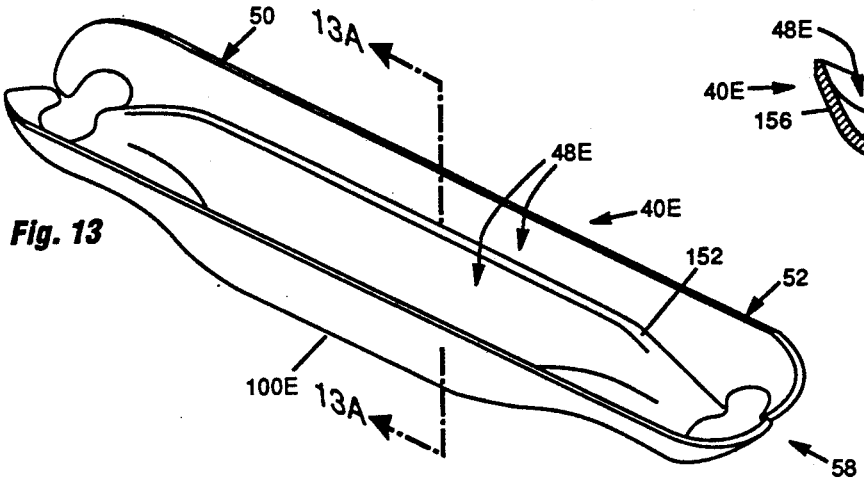
Fig. 13
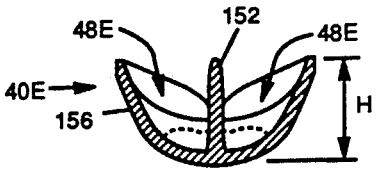
Fig. 13A
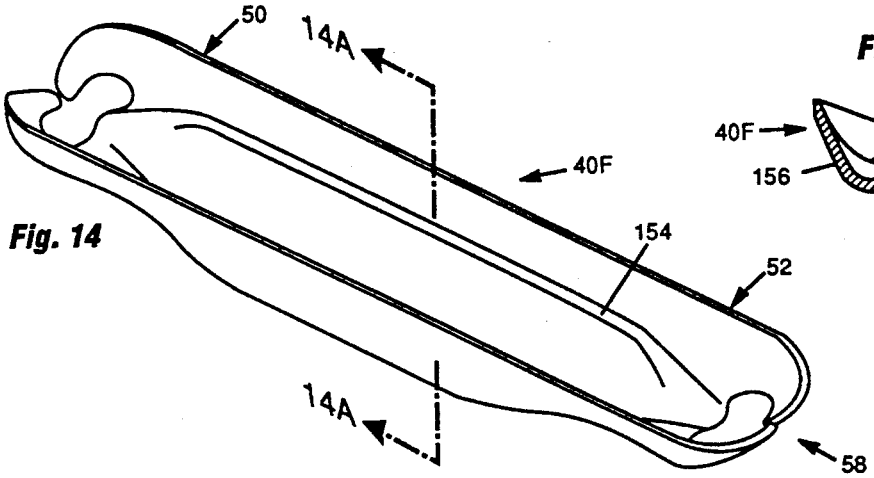
Fig. 14
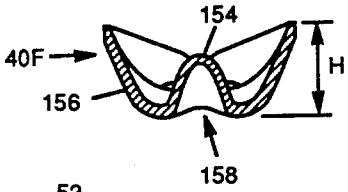
Fig. 14A
Fig. 15
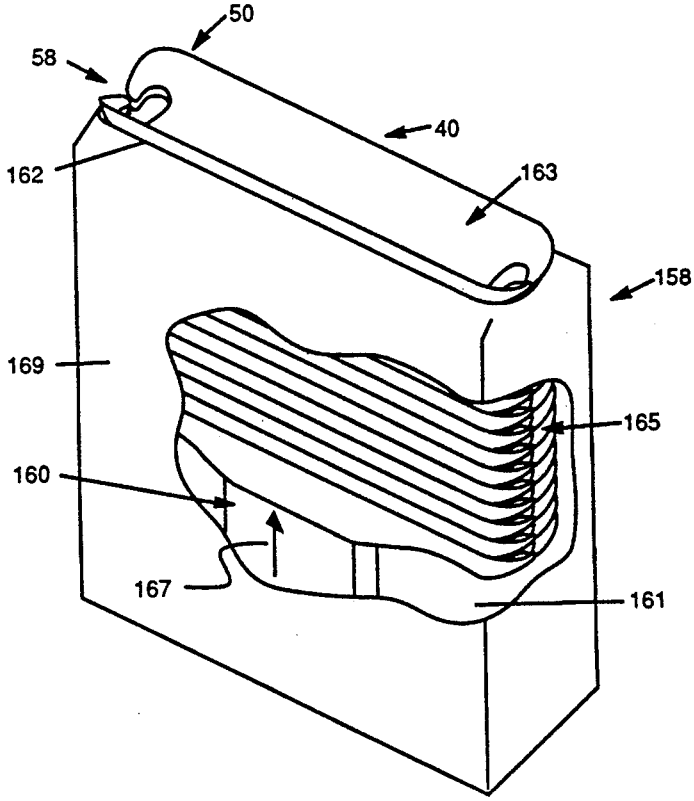

HANDLE FOR PLASTIC BAG

TECHNICAL FIELD

This invention relates to handles for hand-held articles, and more particularly, relates to attachable handles or holders for carrying plastic shopping bags having carrying loops.

BACKGROUND ART

Plastic shopping bags have become increasingly common in the marketplace as replacements for bulkier, more expensive, paper bags. Plastic shopping bags generally have at least two ribbon-like carrying loops or straps extending from the upper rim of the bag for use as handles for carrying the filled bag. These carrying loops, however, tend to bunch together or collapse under loading and can cut into a user's fingers, especially if the bag is filled with heavy items. In addition, the thin plastic bags are not self-supporting and are more likely than paper bags to fall over and spill their contents when they are placed on a support surface and not carried by the loops.

To counteract these shortcomings, grocery store baggers often do not fill the plastic bags completely, requiring a greater number of bags to be provided by the store or supermarket. These additional bags represent an additional cost to the supermarket which is passed on to the consumer.

Plastic bags also are awkward for customers to manage in transit from the store since they often fall over and spill their contents.

Some stores have attempted to reduce spillage by tying the bag loops together. Although no additional expense is introduced, tied bag loops can be difficult to untie, especially after weight is applied. Moreover, tying the bag loops together still does not overcome the carrying discomfort resulting from gripping the thin plastic carrying loops.

Other stores solve the problem of the inability of plastic bags to be self-supporting by fastening bag loops closed with a wire twist-tie or a plastic bread-bag closure device. Twist-ties however, can be awkward to remove, and plastic bag closures still do not solve the problem of carrying discomfort. World Manufacturing, Inc. is manufacturing a T-shirt bag closure which fastens the bag loops with a double-notched flat plastic piece similar to bread-bag closures. Although this device adequately fastens a bag's loops, it is somewhat difficult to attach and it does nothing to alleviate, and even can add to, the discomfort of carrying plastic bags. Thus, consumers still do not want plastic bags to be filled with the same number of items as can be placed in paper bags.

Prior to the introduction of inexpensive plastic bags with integral loops, several types of attachable bag handles were created to carry bags with string-type carrying loops or parcels wrapped with twine, for example, the devices disclosed in U.S. Pat. NOS. 1,618,854 to Worth; 2,287,329 to Santa Maria, et al., 2,684,797 to Schulte; 2,717,411 to Taipale; 3,149,367 to Dills; and 3,800,361 to Stauffer. Although perfectly adequate for their intended use, these devices have various disadvantages. Some are not suitable for the rapid insertion of wide, ribbon-like bag loops found on plastic bags. They are not stackable, which makes dispensing and storage of such bag holders more difficult, and most of these prior art attachable handles would be prohibitively expensive to manufacture and supply to consumers. Further and very importantly, these prior art attachable handle devices are of poor ergonomic design. They place a disproportionate load on the user's finger conform well to the user's hand.

U.S. Pat. No. 4,590,640 to Enersen, and an Italian bag grip offered by Williams-Sonoma of San Francisco, Calif. are designed specifically for plastic bags. While they are easily attachable to the bag, they also are easily removable and do not lock the bag carrying loops together. These devices have to be reattached each time the bags are set down, leaving the bags vulnerable to spillage and causing the user to have to re-manipulate the bag loops. As with the previously mentioned devices, the Enersen and Williams-Sonoma bag loop holders are not efficiently stackable, and they are bulky and expensive to manufacture, requiring substantial raw material.

OBJECTS OF INVENTION

Accordingly, several objects and advantages of my invention are:

(a) to provide a bag holder which can be attached easily and rapidly to wide, ribbon-like plastic bag loops;

(b) to provide a bag holder which is easily attachable to allow entry of bag loops or the like, but will not be easily removed from the bag loops;

(c) to provide a bag holder which can be used to lock a bag's carrying loops together, even when the bag is set down, thus reducing potential spillage of the bag's contents, comfortably allowing higher item count per bag, and effecting a reduction in the number of bags which must be supplied by the market;

(d) to provide a bag holder which can lock and group two or more bags together;

(e) to provide a bag holder which will not be slippery when handled with sweaty or greasy fingers;

(f) to provide a bag holder which is designed to evenly distribute bag load over the gripping fingers and provide sufficient gripping surface area so as not to cut the user's fingers;

(g) to provide a bag holder with a finger indentation pattern designed to provide both a firm positive grip for either three or four fingers, allowing equally comfortable use for large or small hands, and enabling a user to alternate between 3 and 4 fingers, so that the same carrying position need not be maintained for too lengthy a period of time;

(h) to provide a bag holder which has a finger indentation configuration which provides transverse strength and enables the handle to have a very thin, substantially uniform wall thickness;

(i) to provide a bag holder which conforms to the hand, and displays a shock-absorbing longitudinal flex, yet maintains its structural integrity;

(j) to provide a bag holder which is lightweight and can be manufactured economically, with minimum material;

(k) to provide a bag holder which is readily stackable for purposes of efficient storage and dispensing, and for the purpose of using two handles at once for supporting particularly heavy loads; (l) to provide a dispenser for easily and rapidly dispensing stored bag holders;

(m) to provide a process for rapid dispensing bag holders the operation of which requires a very short learning period.

Further objects and advantages are to provide a lightweight, one-piece, attachable, bag holder which allows a user to comfortably carry one or more bags, is simple to use and inexpensive to manufacture, can be efficiently supplied either loosely packed or stacked in cartridges for use in a dispenser, and can be reused as well as recycled. Other objects and advantages of the invention will appear from the drawing and the following description wherein the preferred embodiments are set forth in detail.

DISCLOSURE OF INVENTION

The attachable bag holder or handle of the present invention is formed with an elongated body terminating in opposed ends. An upwardly facing side of the bag holder body has a channel formed to receive a bag carrying loop, and a manually engageable gripping surface is provided in a downwardly facing side of the holder body.

The improvement in the attachable bag holder of the present invention resides broadly in three areas. In one aspect of the present invention the improvement in the bag holder comprises, briefly, a retention or restrictor structure carried by the holder body which is formed for easy loop entry but which resists loop removal. In another aspect of the present invention the improvement is comprised, briefly, of a body which is formed with a channel which enables stacking of similarly formed holders in nested relation. In the third aspect of the present invention, the improvement is comprised, briefly, of the gripping surface being downwardly convex and formed with finger indentations which distributes the loading forces on the holder substantially evenly among the fingers and provides a firm positive grip.

The present invention further includes a dispenser for dispensing stacked attachable bag holders and a process for dispensing the same.

BRIEF DESCRIPTION OF THE DRAWING

FIG. 13 is a top perspective view of another alternative embodiment of the bag holder shown in FIG. 2.

FIG. 13A is an end elevation view, in cross section, taken substantially along the plane of line 13A—13A of FIG. 13.

FIG. 14 is a top perspective view of another alternative embodiment of the bag holder shown in FIG. 2.

FIG. 14A is an end elevation view, in cross section, taken substantially along the plane of line 14A—14A of FIG. 14.

FIG. 15 is a top perspective view of a vertically stacked assemblage of bag holders according to the present invention, held in a dispensing device.

BEST MODE OF CARRYING OUT THE INVENTION

The attachable bag holder or handle of the present invention has a deceptively simple appearance, but when carefully considered, it will be seen to contain numerous structural subtleties which result in significant user advantages as compared to prior attachable bag holders. Three areas of particular advantage can be broadly identified, namely, rapid attachment and yet difficult removal, stackability, and greatly improved ergonomics. These areas of advantage combine to produce an attachable bag holder which is particularly well suited for use with plastic shopping bags of the type widely employed by supermarkets.

Figure 2:
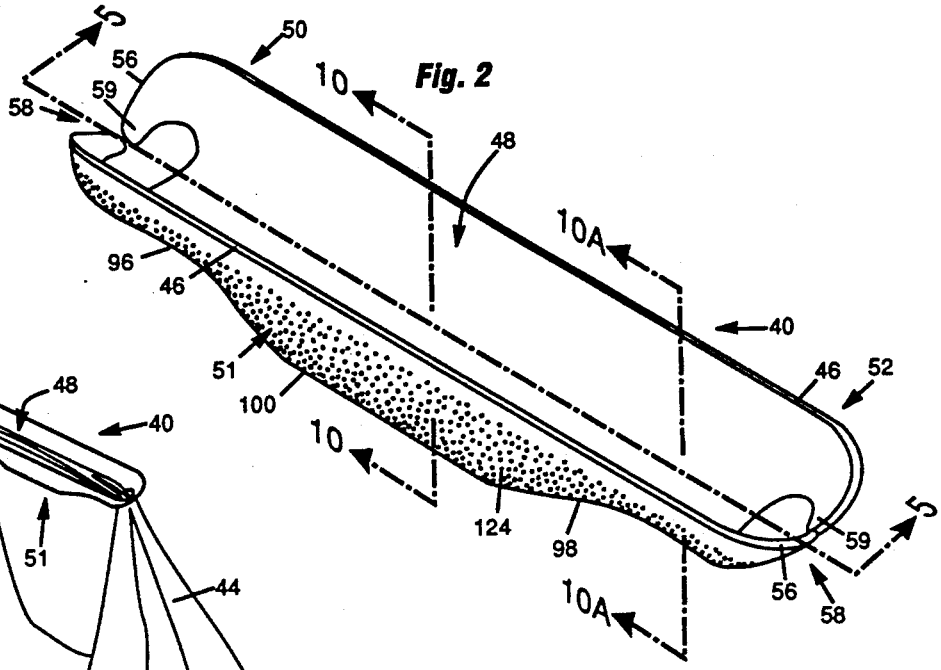
FIG. 2 is an enlarged, top perspective view of the bag holder illustrated in FIG. 1.
Figure 1:
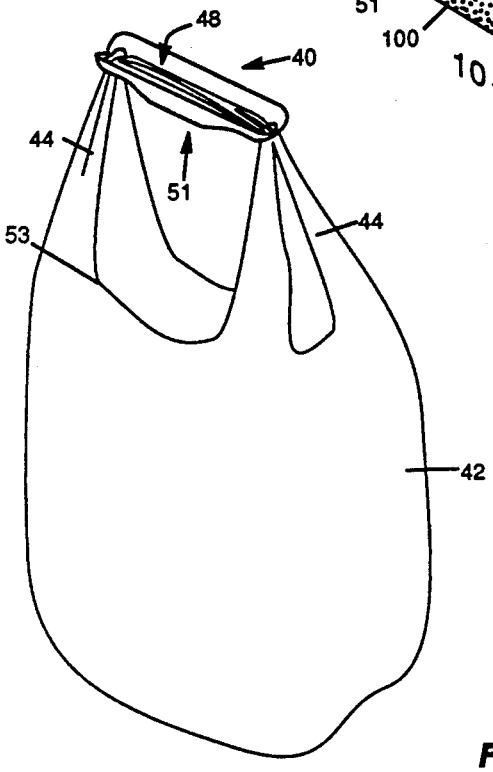
FIG. 1 is a top perspective view of an attachable bag holder constructed in accordance with the present invention and attached to a plastic bag.

As best may be seen in FIG. 1, an attachable bag holder, generally designated 40, may be mounted to one or more of the ribbon-like carrying straps or loops 44, which are provided at the top of bag 42. In most situations bag 42 will have two carrying loops 44 and holder 40 will be attached to both loops. It will be understood, however that holder 40 could be attached to only one of loops 44, and that bag 42 can be formed with one or more carrying loops.

The details of construction of the attachable bag holder of the present invention can best be understood by reference to FIGS. 2 through 5. Holder 40 has an elongated body which terminates in opposed ends 50 and 52. Formed in an upwardly facing side of the holder body is a loop receiving channel 48, which preferably extends over the entire length of the holder. A downwardly facing side of the holder is formed with a manually engageable gripping surface, generally designated 51. The bag holder structure thus far described is known broadly in the prior art and is shown, for example, in U.S. Pat. No. 4,590,640 to Enersen.

In a first aspect of the present invention, the improvement in the bag holder 40 resides in the provision of restrictors or retention means, generally designated 58, on the bag holder body. Most preferably, retention means 58 is provided at each of ends 50 and 52, and the retention means is formed for easy entry and passage of a portion of the carrying loops from a position outwardly of the retention means to a position inwardly of the retention means for support of the loops in loop-receiving channel 48.

In order to insure that holder 40 will not fall off of the loops when the bag is placed upon a supporting surface and not carried by the loops, it is an important feature of the present invention that retention means 58 further be formed to resist removal of loops 44 from the position inside retention means 58. Thus, retention means 58 of the present invention is constructed for easy attachment of the holder to the bag loops and yet significantly more difficult removal of the holder from the bag loops. When the user lets go of the holder, therefore, the holder does not fall from the loops 44, which are not self-supporting, but instead, holds the loops together to keep the bag upper end 53 from opening sufficiently to spill the contents of the bag. This feature avoids the necessity for tieing the bag loops 44 together or wrapping the same with a wire-tie or other closure to prevent spillage. Thus, bag 42 can be filled with more items without resulting in spilling of the contents, for example, as often occurs when the bag is being transported from the store to the consumer's home.

Figure 4:
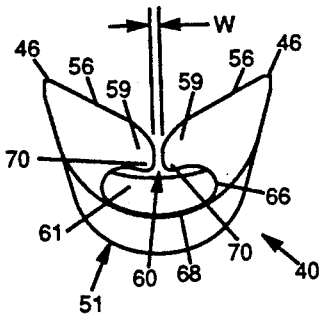
FIG. 4 is an end elevation view of the bag holder illustrated in FIG. 2.
Figure 3:
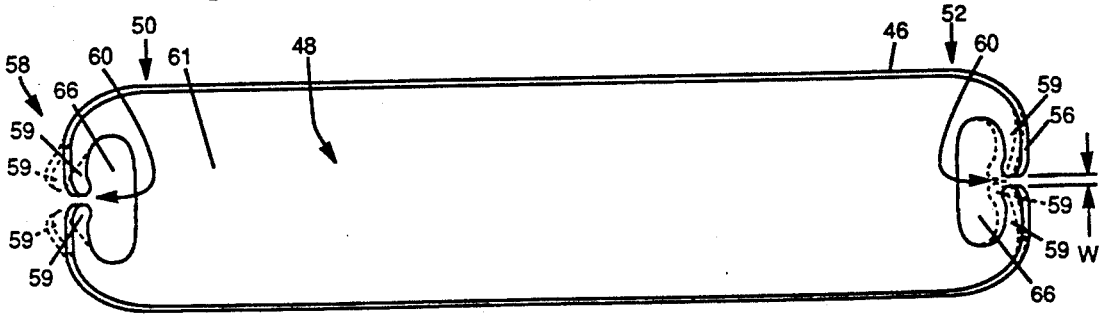
FIG. 3 is a top plan view of the bag holder illustrated in FIG. 2.

Referring to FIGS. 3 and 4, the details of construction of restrictor or retention means 58 can be described. It is most preferable that retention means 58 be integrally formed with the ends 50 and 52 of the holder body. In order to permit rapid entry of ribbon-like loops 44 to a position beyond the retention means, it is preferable that the top surface or edges 46 of the holder body at ends 50 and 52 converge downwardly at entry guide surface 56 toward an entry passageway or slit 60, as best may be seen in FIG. 4. The restrictor structure itself is most preferably provided by a pair of opposed hook-like tabs 59 which define an entry passageway therebetween. Tabs 59 cantilever outwardly towards each other from the main body of the holder ends and are resiliently displaceable in an outward direction, as shown in broken lines at the left end of FIG. 3. As tabs 59 are displaced outwardly when loops 44 are pulled down over guide entry surfaces 56, channel 60 increases in its width W, thus further facilitating entry of loops 44 to a position inwardly of the restricting tabs 59.

Ends 50 and 52 also are formed with a loop enclosure or opening 66 which slidably receives loops 44 once they have passed beyond restrictor tabs 59. Loop receiving opening 66 may be dimensioned for sliding receipt of a plurality of loops. Thus, once the holder is attached to one or more loops 44, it can be adjusted along the loops to insure that it is in a horizontal position for carrying of the bag.

In addition to the resistance to removal of the loops which results from the rounded hook-like ends 70 of tabs 59, the resiliently displaceable nature of the restrictor tabs 59 also works to prevent loop removal. As best may be seen at the right end of FIG. 3, if one attempts to pull the loops up against tabs 59, the tabs tend to flex inwardly and close width W of channel 60. Thus, removal is further resisted by the resiliently displaceable tabs moving toward each other when the loops are attempted to be lifted out of the channel 48 and pulled outwardly of restrictor means 58.

Figure 5:
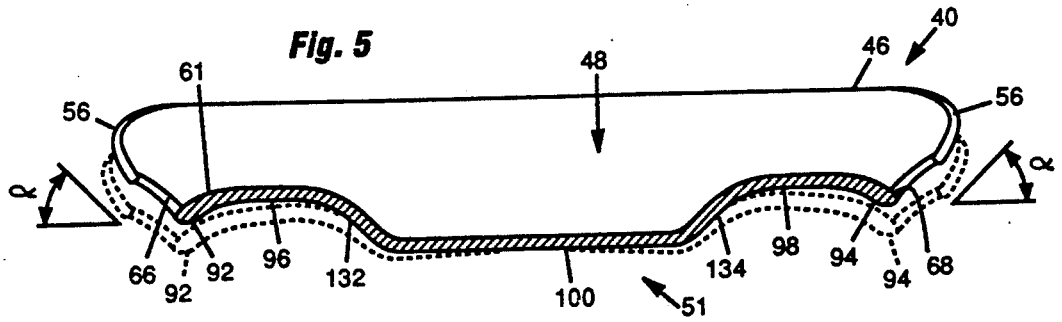
FIG. 5 is a side elevation view, in cross section, of the bag holder illustrated in FIG. 2, taken substantially along the plane of line 5—5 of FIG. 2 and showing the holder in a flexed condition under loading.

As best may be seen in FIG. 5, ends 50 and 52 of the holder preferably are at an angle $\alpha$ from a horizontal plane which allows resilient deformation of tabs 59 to occur in an outward direction from cavity 48 when the bag loops are brought down onto compound curved entry surface 56. Thus, the sloping ends produce the outward displacement of the tabs which increases the width W of channel 60. Conversely, the slope $\alpha$ of end tabs 59 causes inward resilient deformation of the tabs toward cavity or channel 48 to reduce the width of the entry slits or passageways when one tries to lift the loops up against the sloped end tabs.

As also best may be seen in FIG. 5, the entry guide surface 56 is preferably formed as a compound curve (a curve occurring on two different planes). Structurally, compound curve surface 56, in combination with the material's resilient qualities, forces each restrictor tab 59 to return to its original position following deformation which occurs when loop 44 is either inserted into, or removed from, the loop receiving opening 66.

Figure 4A:
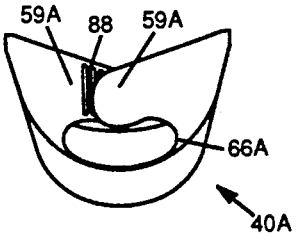
FIG. 4A is an end elevation view of an alternative embodiment of the bag holder illustrated in FIG. 4, shown with locking structure.

In FIG. 4A a modified form of the holder of the present invention is shown. Holder **40*a* is again formed with hook-like tabs 59*a* that define an entry passageway to a bag loop receiving opening 66*a*. In this case, however, tabs 59*a* are in partially overlapped relation, making removal of loops 44 from opening 66*a* even more difficult. Additionally, mating ratchet protrusions 88 can be formed on the outside of one of tabs 59*a* and inside of the overlapping tab 59*a* so as to more positively lock or secure tabs 59*a*** in an overlapped relation which prevents removal of the bag loops.

In order to minimize the stress concentration on loops 44 as they pass over the ends of holder 40, lower surface 68 (FIG. 4) of loop receiving opening 66 must be sufficiently wide so as not to over-stress and tear or cut the loops. Thus, it is preferable that opening 66 be somewhat wider than it is high (an ovaloid shape), and as best may be seen in FIG. 5, the rounded upper surface 61 in combination with the edge 68 tends to distribute the stress on the bag loops in a manner that maintains the loop's integrity.

Figure 4B:
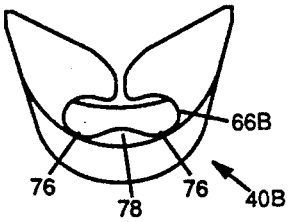
FIG. 4B is an end elevation view of a further alternative embodiment of the bag holder illustrated in FIG. 4.

A further alternative embodiment of the holder of the present invention is shown in FIG. 4B in which the holder **40*b* has an opening 66*b* with a lower edge over which the bag loops pass that includes a pair of notches 76. The notches tend to disperse the loop load and prevent the loops from settling into the center 78 of the opening 66*b***. Such concentration of the loop load in the center of the loop receiving opening can potentially cause undesirable deformation under heavy bag loads.

In a second aspect of the attachable bag holder of the present invention, the improvement in the bag holder resides in the holder body being constructed to provide significantly improved ergonomics. Gripping surface 51 in the bag holder of the present invention is both downwardly convex and includes finger indentations or is provided with shoulders which resist slipping of the user's hand along the holder body. Most prior art handles have a straight gripping surface (U.S. Pat. No. 2,800,940 to Riesebeck) or even an upwardly convex surface (U.S. Pat. No. 2,287,329 to Santa Maria, et al.). Both structures are extremely undesirable since they transfer loading undesirably to the muscles of the hand, as is set forth in more detail below.

There are handles or holders with slightly downwardly convex gripping surfaces, such as the holder disclosed in U.S. Pat. No. 1,226,403, but such references have not recognized that any benefit accrues from the downward curvature of the handle gripping surface. Moreover, and more importantly, such downwardly convex prior art attachable handles have not included finger indentations in combination with the downwardly convex surface. Still further, such bag holder devices have not incorporated the advantages of a downwardly convex surface and finger indentations into a thin, lightweight and yet rigid, shell-like body.

Figure 6:
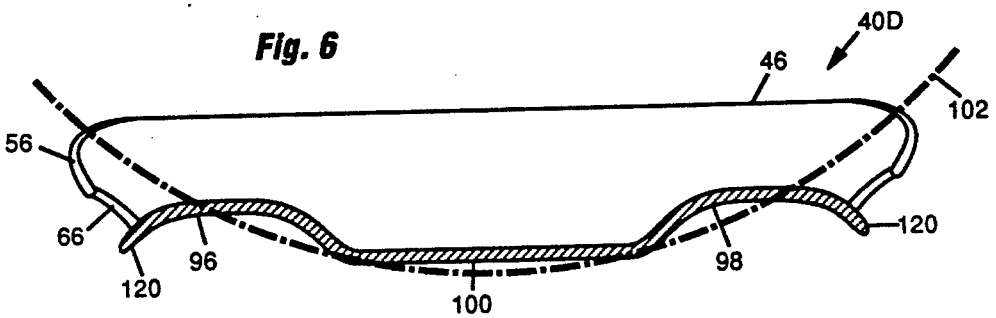
FIG. 6 is a side elevation view of an alternative embodiment of the bag holder illustrated in FIG. 5.

The importance of the feature of having finger support areas which lie on or form a downwardly convex arch can best be understood by reference to FIGS. 5 through 9. The finger support areas on gripping surface 51 include finger indentations 96 and 98 proximate each of opposed ends 50 and 52. Intermediate the finger indentations 96 and 98 is a relatively downwardly protruding finger support area or ridge 100. Ridge 100 preferably has a length dimension which is sufficient to support at least two fingers thereon (for example, the ring finger and middle finger). Ridge 100, however, preferably has no finger indentations so that holder 40 may be used comfortably with either three or four fingers engaging gripping surface 51. Users with large hands will tend to use three fingers, while small-handed users may use all four fingers to grip the holder body. Some users will find that finger ridge 100 enables them to alternate between three and four fingers so that the same carrying position need not be maintained for too lengthy a period of time. Although it is preferable that there be no indentations in finger support ridge 100 so as to enable changing between three and four fingers, it is possible to provide finger positioning indentations in ridge 100, as long as the indentations in ridge 100 protrude with respect to the indentations 96 and 98 proximate the ends of the holder. The key to distribution of the loading forces among the user's fingers resides in the relative downward protrusion of the finger support ridge 100 with respect to finger indentations 98 and 96 so as to form a downwardly convexed arch 102 (FIG. 6).

Figure 9:
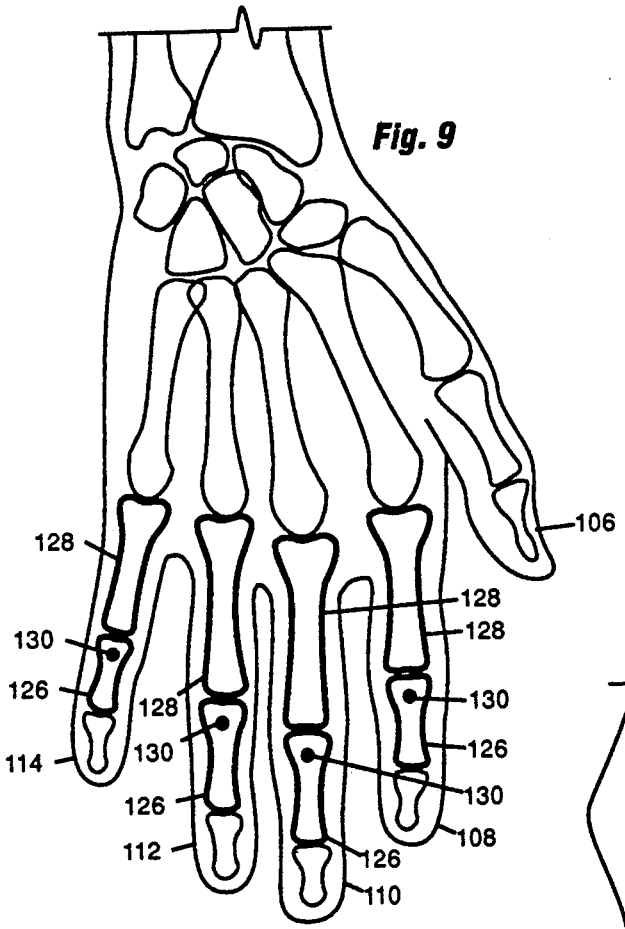
FIG. 9 is a front elevation view of a human hand illustrating the skeletal structure.
Figure 8:
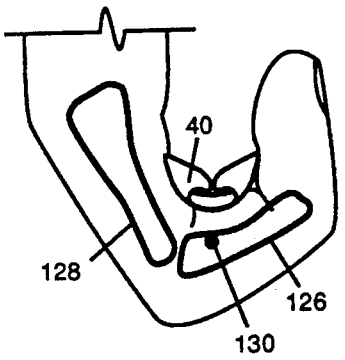
FIG. 8 is an end elevation view of one finger, including the bone structure, of the human hand shown holding the bag holder illustrated in FIG. 2.
Figure 7:
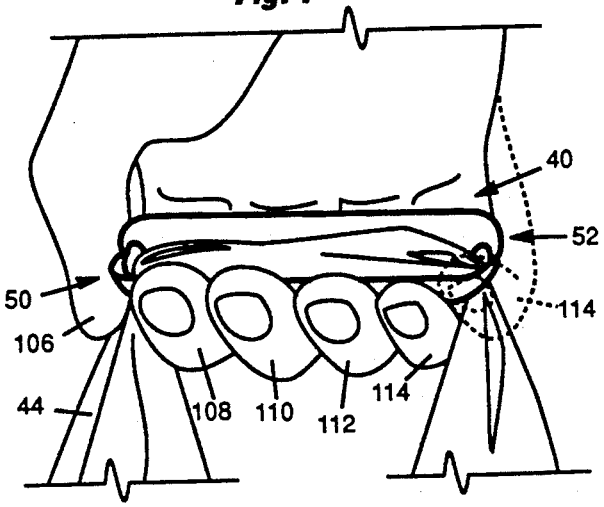
FIG. 7 is a top perspective view of the bag holder illustrated in FIG. 2 in a user's hand.

The importance of a holder gripping surface which is downwardly convex can best be understood by reference to FIGS. 8 and 9 which shows the skeletal structure of a human hand. To carry a handled load at one's side it is preferred that the proximal phalange 128 of each finger extend downward and the handle or holder be positioned approximately over the base 130 of each middle phalange 126 of the hand. Such positioning minimizes the cantilevering of the load further out on middle phalange 126. A downwardly convex gripping surface 51, therefore, allows the bag load to be borne more by the extended proximal phalange 128 and less by the muscles of the hand, reducing fatigue. As can be seen in FIG. 9, middle phalange base 130 of the center fingers (ring finger 112 and middle finger 110) extend significantly below the middle phalange base 130 of the outer fingers (index finger 108 and either ring finger 112 or little finger 114, depending on whether three or four fingers are used). Thus, downwardly protruding finger ridge 100 (accommodating either one or two center fingers) protrudes specifically to allow handle 40 to be positioned over middle phalange base 130 of each finger simultaneously. Prior art handles which are constructed with finger support areas that fall on the same plane or an upwardly convex arch, such as the handle in U.S. Pat. No. 2,287,329, cause undesirable hand muscle fatigue.

In the downwardly convex arch of the gripping surface of the holder of the present invention, therefore, a greater portion of the load is transferred to the bones of the hand, and the load is distributed more evenly between the fingers, relieving the center fingers from bearing a disproportionate load.

The addition of indentations to gripping surface 51, such as finger indentations 96 and 98 proximate ends 50 and 52, further enhances the positive nature of the gripping surface. Thus, the sholders, such as shoulders 92 and 94 and sholders 132 and 134, defining indentations 96 and 98, limit sliding or slipping of the fingers longitudinally along the holder. If holder 40 is mounted to loops 44 in a slightly skewed relation to the horizon, for example, the user's hand will not slip along the holder as the bag is lifted and weight is applied to holder 40. Even when horizontally oriented, the presence of finger indentations gives the user a much more positive and firm-feeling grip. This combines with the downwardly convex arc, on which the finger support surfaces lie, to further reduce user hand fatigue.

The attachable bag holder **40*d*, shown in FIG. 6, is modified as compared to the holder 40 shown in FIG. 5 by providing extensions 120 on finger indentations 96 and 98. Extensions 120 act as finger guards that extend out away from the holder to provide a generous buffer between the outside fingers 114 and 108 and bag loops 44. Even in the form of the invention shown in FIG. 5, finger guards or shoulders 92 and 94 extend sufficiently to support the loops 44** and guard the outside fingers.

The configuration of gripping surface 51 also substantially effects the overall rigidity of holder 40, in both the transverse and the longitudinal directions. This effect allows the holder to be formed as a thin, shell-like member. The upwardly concaved finger indentations 96 and 98 extend transversely across the holder body with the result that the transverse sloping surfaces 132 and 134 proximate finger ridge 100 and the sloping transverse surfaces 92 and 94 proximate ends 50 and 52 add transverse or circumferential rigidity to the holder. The finger indentations, therefore, tend to prevent collapse of the sides of the holder towards each other, notwithstanding the fact that the holder is formed with a thin shell-like body. Longitudinally, finger ridge protrusion 100 in combination with indentations 96 and 98, has the effect of stiffening the holder against longitudinal bending about a transverse axis through the center of the holder. Some bending is permitted, as shown in FIG. 5, but finger ridge protrusion 100 effects stiffening against such bending without need to have excessive material in the holder. Thus, the body of holder 40 can be formed as a hollow shell-like structure with thin, substantially uniform walls.

Finally, with respect to the gripping surface 51, the upwardly sloping ends 50 and 52 of the holder afford downwardly facing surfaces which can be engaged, for example, by the thumb 106 of the user's hand. Additionally, as best may be seen in FIG. 7, little finger 114 can be moved to the dotted line position in FIG. 7 to engage the opposite downwardly facing end 52 of the holder to additionally support the bag weight.

Figure 11:
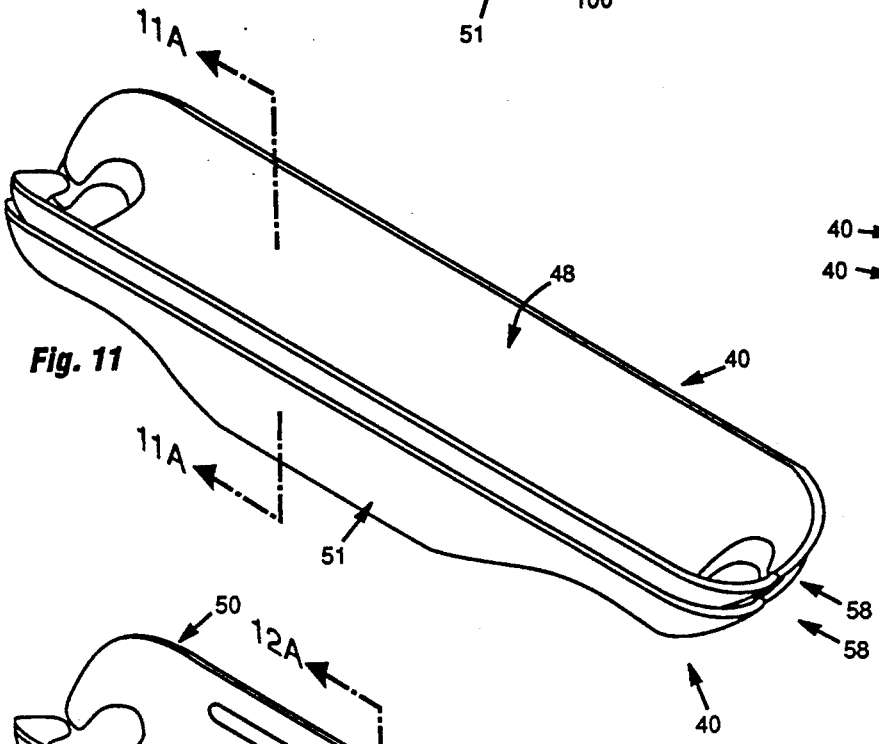
FIG. 11 is a top perspective view of two of the bag holders illustrated in FIG. 2, stacked in nested relation according to the present invention.
Figure 11A:
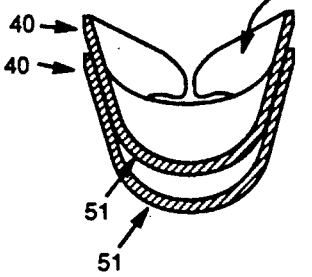
FIG. 11A is a cross-sectional view of the bag holders illustrated in FIG. 11, taken substantially along the plane of line 11A—11A of FIG. 11.

In a third aspect of the present invention, the rigidity provided by the configuration of gripping surface 51 that enables the holder of the present invention to be formed as a hollow member has the additional substantial advantage of making the holders stackable. Thus, the holder body is formed for receipt of a gripping surface of a similarly formed second holder in nested relation to the loop receiving channel. This may best be seen in FIGS. 11, 11A and 12B. The U-shaped transverse cross section and open top of channel 48 diverges slightly so as to receive gripping surface 51 of a similarly formed holder. Nesting of the two or more holders together greatly reduces the volume in which a plurality of holders can be stored, and it makes it very practical to dispense holders from a dispensing apparatus in which the holders are held in a stacked relation as shown in FIG. 15. As will be seen from FIGS. 11A and 12B, the shell-like holders can be nested to a substantial degree within each other. It should also be noted that the outward sloping of the ends, together with the outward sloping of the side walls, of channel 48 facilitate such nesting or stacking. Thus, the retention means provided in the holders does not interfere with the stacking function.

Figure 10:
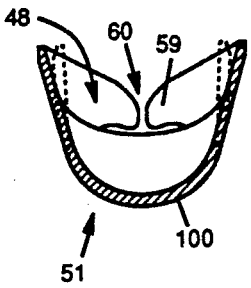
FIG. 10 is an end elevational view, in cross section, of the bag holder taken substantially along the plane of line 10—10 of FIG. 2.
Figure 10A:
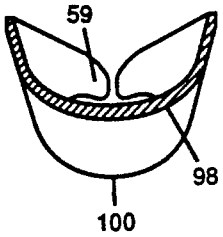
FIG. 10A is an end elevation view, in cross section, of the bag holder taken substantially along the plane of line 10A—10A of FIG. 2.
Figure 12:
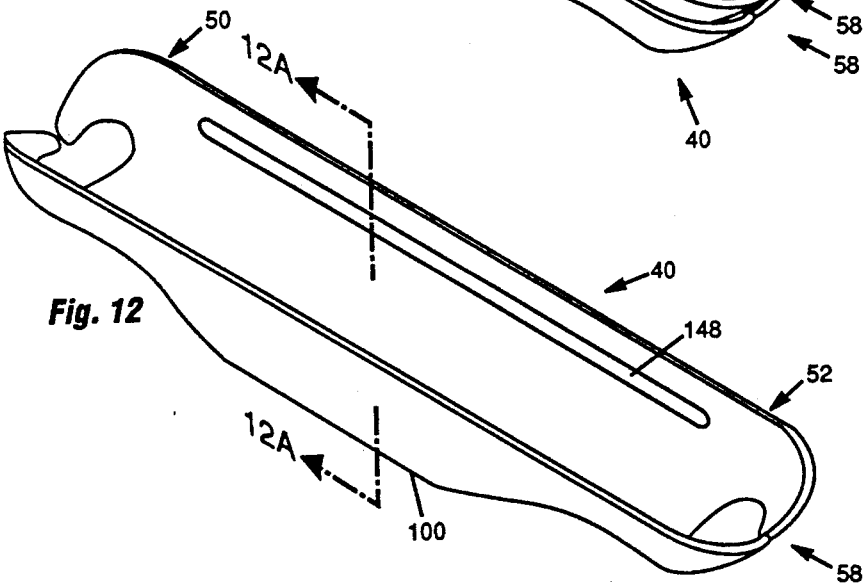
FIG. 12 is a top perspective view of an alternative embodiment of the bag holder shown in FIG. 2.
Figure 12A:
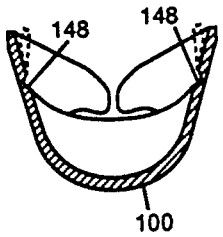
FIG. 12A is an end elevation view, in cross section, of the bag holder illustrated in FIG. 12, taken substantially along the plane of line 12A—12A of FIG. 12.
Figure 12B:
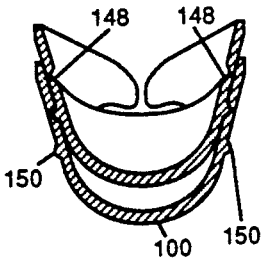
FIG. 12B is an end elevation view, in cross section, of two bag holders, as illustrated in FIG. 12 and stacked in nested relation.

In order to further control the flexing of bag holder 40, it is preferable that the wall thickness of the bag holder be changed somewhat in certain areas. First, the side walls can taper slightly from the bottom of channel 48 upwardly to the edges 46 of the side walls. This slight tapering permits flexing of the side walls toward each other under leading, as seen in dotted lines in FIG. 10, which allows the holder to conform somewhat better to the user's hand and thereby enhance comfort. This transverse flexing inwardly of U-shaped holder can be further enhanced, if desired, by providing longitudinally extending notches 148 in the inner side walls of the holder body, as shown in FIGS. 12, 12A and 12B. Such notches will enable inward flexing of the upper edges 46 of the holder body while still maintaining an outwardly diverging side wall which readily accepts a similarly formed holder in nested relation thereto. Longitudinally extending notches 148 may also assist injection molded manufacture of holder 40 by providing a slight undercut. When the mold is opened, the undercut keeps the part attached to the portion of the mold which contains the cooling system and ejector pins.

Another wall thickness variation which can be employed advantageously in the holder of the present invention is for the wall thickness proximate finger indentations 98 and 96 and the ends of the holder to be somewhat thicker in order to limit deformation of the holder in the area of exiting of the bag loops from the holder. Thus, as is shown in FIG. 5, the wall thickness of the holder at indentations 96 and 98 and out into shoulders 92 and 94 gradually increases. Such increases in wall thickness, however, need only be on the order of a few thousandths of an inch as compared to the nominal wall thickness of the holder body.

Stacking of holders in nested relation can also be enhanced by providing a longitudinally extending rib 150 (FIG. 12B) on the exterior surface of the holder that is positioned to mate with the longitudinally extending groove 148 of a similarly formed holder. The groove and ridge construction, together with the resiliently displaceable side walls of the holder allows the holder to be snapped into a stacked relation and yet easily pulled apart.

If longitudinal flexure about a transverse horizontal axis of the holder body is to be further resisted, it is possible to construct the holders of the present invention with central ribs. FIGS. 13 and 13A show a modified form of holder **40*e* in which a central rib structure 152 extends along bag loop receiving channel 48*e*. As best may be seen in FIG. 13A, this results in two sub-channels 48*e*, each of which may receive one of bag loops 44 on a typical two-loop bag. The center ridge 152 allows the side walls 156 to have a lower height dimension H. since bending is now resisted by rib 152, as well as the side walls and protruding bottom finger support ridge 100*e***. The disadvantage of this structure is that the holders cannot be stacked in nested relation to each other.

The form of the holder of the present invention shown in FIGS. 14 and 14A similarly has a central ridge 154, but the ridge is formed by an inverted V-shaped wall with an opening 158 which can receive a similarly formed central ridge 154 to facilitate stacking. Again, the presence of central ridge 154 in holder **40*f* allows the side walls 156** to have a lower height dimension with the same overall longitudinal rigidity.

The bag holder of the present invention can be easily attached by manual manipulation or with the aid of a bag holder dispenser. If holders 40 are attached by the user without the use of a dispenser, both hands of the user are used to collect loops 44 and then draw them down into the retention or restrictor structure and bag receiving channel 48. The V-shaped guide surfaces 56 guide and collect the loops into the slit or passageway 60. The downward force of the loop then urges the same into the openings 66, where they are trapped by the restrictor tabs 59.

FIG. 15 shows an attachable bag holder dispenser 158 which is capable of holding and dispensing a relatively large number of stacked holders 40. The vertical stacking of holders 40 enables the dispenser size to be minimized. The dispenser includes a stack guideway, generally designated 161, which orients stack 165 of holders 40 for advancement toward a dispensing station, generally designated 163. Biasing means, such as spring biasing assembly 160, biases stack 165 of holders 40 in an upward direction, as indicated by arrow 167, toward dispensing station 163.

Holder dispenser 158 further includes detent means at dispensing station 163 for releasably retaining bag holders 40 in stack 165 of the guideway 161. Such a detent can be provided by spring means (not shown) or merely by sizing opening 162 at the top of dispenser housing 169.

In order to permit easy attachment of holders 40 to the bag loops, it is further preferable that dispenser 158 be constructed such that the retention means 58 of the uppermost holder 40 is exposed at its ends to receive bag loops 44. With the holders 40 so oriented at the dispensing station, bag loop 44 can simply be pulled down into retention means 58 to attach the loop to the holder. The bag loop can then be pulled upwardly, and the restrictor tabs 59 will collapse in and trap the loop against removal. The bag loop will, therefore, pull the holder out of dispenser 158 against the detent at the dispensing station.

In use, therefore, bags can be filled immediately adjacent dispenser 158, and when they are ready to be carried, both loops lifted up over dispensing station 163 and then pulled down into retention means 58. The loops can then be lifted to pull the holder from the dispenser and permit the user to lift the bag by the bag holder. The dispenser spring biasing mechanism 160 urges the next holder 40 to the dispensing station for attachment to the next bag.

As will be seen, therefore, the holder of the present invention also affords a process for dispensing bag holders in which there is an attaching step that is accomplished by inserting at least one loop of the bag into retention means in the holder while the bag is in a dispenser. Additionally, dispensing is effected by pulling the bag from the dispenser to urge the holder past detent means in the dispenser while the retention means 58 prevents removal of loop 44 from the holder.

While the dispenser is shown in FIG. 15 in a vertical orientation, it will be obvious to those skilled in the art that dispenser 158 could also be rotated to virtually any angular orientation which is convenient to the dispensing process. The process still would entail attachment of the bag loop by inserting the loop into the retention means and pulling of the bag loop away from the dispenser so that the retention structure traps the loop and enables pulling of the holder past the detent in the dispenser.

While holder 40 is most simply affixed to bags 42 by first filling the bag with the desired contents and thereafter attaching the holder, it is conceivable, that the holder could be attached before filling the bag. This is generally more awkward for supermarkets, but if the holders are used in connection with bags that are to receive powdered or granular material, it may be very desirable to attach the holder before filling the bag with a spout or the like.

In order to remove holders 40 from the loops, it is preferred that bag 42 first be set down on a support surface. Holder 40 then is rotated by approximately 180 degrees and pulled up and away from bag loops 44. Rotation of holder 40 by 180 degrees now causes loops 44 to rest on the outwardly inclined ends of the holder. Pulling the holder up resiliently displaces the ends inwardly by a sufficient distance to again open the channel and permit passage of the loops past restrictor tabs 59. Loops 44 may be pulled away from the holder if the weight of the bag alone will not be sufficient to release the loops from the holder.

Holders 40 may be simultaneously affixed to more than one bag 42. As many as three or four bags, for example, can be placed in loop channel 48 and will extend through the end openings 66. Should the combined bag weight become excessive, it is possible to stack one holder within the other for structural reinforcement. Thus, the stacked configuration of holders shown in FIG. 11 can be used to lift heavy loads or multiple bags.

The attachable bag holders of the present invention are constructed in a manner which allows them to be formed of thin, relatively lightweight plastic. For example, injection molded polyethylene or polypropylene can be used to manufacture a bag holder which weighs only 2.3 grams, but is capable of holding a bag filled with 45 pounds of weight. Such a bag holder, for example, would have a length of about 3.1 inches, a height dimension of about 0.55 inches, a width dimension at the top of channel 48 of about 0.80 inches and an average wall thickness of about 0.050 inches. Both polyethylene and polypropylene are resilient plastics which are durable, reusable and readily recycled. It is also possible for the injection mold to include surface texture 124 (FIG. 2) which increases the user's frictional grip on gripping surface 51. If the internal surface of cavity or channel 48 is also textured (not shown) the combined texturing of the interior and exterior surfaces assists in retaining stacked holders together as a unit.

Holders 40 of the present invention can be re-used many times, but their simple and inexpensive structure allows them also to be easily disposed of or recycled. Since supermarket shopping bags are often used by homeowners to carry trash, one may advantageously keep a supply of holders at home for attachment to trash bags, and the user can either remove or leave the holder on the bag when it is placed in the trash container.

The attachable bag holder of the present invention, therefore, has a structure which enables the simultaneous attainment of several important advantages. First, it enhances the comfort with which bags are carried. It enables heavier bags and bags with greater contents to be carried, thereby making more efficient use of plastic grocery bags. It also reduces the potential for spillage of the bag's contents during transport between the market and the comsumer's home. This, is turn, allows th bags to be filled to a greater degree. The holders are easily attached and can be compactly stored and dispensed by the grocer. The holder itself is flexible for comfort and yet sufficiently rigid to evenly disperse the loading forces over the user's hand. The holder can be used with plastic bags, but it is also suitable for use with paper bags or other containers having loops or straps. While the retention structure has been described as being located at the ends of the holder, it will be understood that a centrally mounted retention structure could be used and loop retainers of other configurations can be incorporated into the bag holder body.

Other changes and modifications to the described embodiments may be made without departing from the scope of the present invention, which is limited only by the scope of the appended claims.

What is claimed is:

1. In a holder for attachment to a bag having at least one carrying loop, said holder including an elongated body terminating in opposed ends, said body being formed with a substantially U-shaped transverse cross section having upwardly extending side walls terminating in edges defining a loop receiving channel on an open upwardly facing side of said body and a manually engageable gripping surface on a downwardly facing side of said body, the improvement in said holder comprising:

retention means formed at each of said opposed ends, said retention means including a pair of opposed tabs cantilevered inwardly toward each other from said side walls at said ends and defining a loop receiving opening therebetween an entry passageway to said opening, said tabs having converging entry guide surfaces proximate and outwardly of said passageway for easy entry and passage of a portion of said loop from a position outwardly of said retention means to a position in said opening for support of said loop along said channel, and said tabs further being formed with hook-like ends extending back towards said opening and resisting removal of said loop from said position in said opening.

2. The holder as defined in claim 1 wherein, said tabs being resiliently displaceable in a direction away from each other to permit entry of said loop to said position inwardly of said retention means, and said tabs being resiliently displaceable in a direction toward each other to resist removal of said loop from said retention means.

3. The holder as defined in claim 1 wherein, said opposed ends each include downwardly converging compound curved surfaces.

4. The holder as defined in claim 1 wherein, said pair of opposed tabs at said ends are upwardly and outwardly sloping from a horizontal plane.

5. The holder as defined in claim 1 wherein, said tabs are normally biased into partially overlapped relation.

6. The holder as defined in claim 1 wherein, said side walls and said tabs are both slightly outwardly diverging for receipt of a similarly formed second holder in nested relation to said channel; and said side walls and said tabs resist relative longitudinal, transverse rotation displacement between nested holders.

7. The holder as defined in claim 1 wherein, said manually engageable gripping surface includes a plurality of finger support areas positioned over the length of said gripping surface with end finger support areas proximate each of said opposed ends and a downwardly protruding central finger support area between said end finger support areas.

8. The holder as defined in claim 1 wherein, said gripping surface has a plurality of finger support areas positioned therealong to rigidify said body against bending about both a longitudinal axis and a transverse axis; and said body is formed for receipt of a gripping surface of a similarly formed second holder nested substantially within said channel.

9. The holder as defined in claim 1 wherein, said manually engageable gripping surface includes at least one transversely extending concave indentation providing transverse stiffening of said body against transverse collapse of said body when loaded; and the wall thickness of said body tapers slightly from a bottom of said channel to the uppermost sides of said side walls to increase flexibility of said body proximate said uppermost sides of said side walls.

10. the holder as defined in claim 9 wherein, said gripping surface includes a longitudinally extending vertically protruding finger support ridge proximate said concave indentation to longitudinally stiffen said body against bending about a transverse horizontal axis.

11. In a holder for attachment to a bag having at least one carrying loop, said holder including an elongated body terminating in opposed ends, said body being formed with a loop receiving channel on an upwardly facing side of said body and a manually engageable gripping surface on a downwardly facing side of said body including a finger support area proximate each of said opposed ends, the improvement in said holder comprising:

said body being a hollow shell-like body having a substantially uniform thin wall over the length thereof and a substantially U-shaped transverse cross section with slightly diverging side walls, and said body further having a longitudinally extending support ridge protruding downwardly relative to and positioned between the finger support areas, said support ridge being connected to said finger support areas by downwardly sloping and converging surfaces whereby the combination of said support ridge and said sloping surfaces stiffens said hollow shell-like body against longitudinal bending about a horizontal transverse axis through said body and transverse bending about a horizontal longitudinal axis down the length of said body.

12. the holder as defined in claim 11 wherein, said finger support areas are provided by a finger indentation proximate each of said opposed ends.

13. The holder as defined in claim 11 wherein, said support ridge protrudes downwardly relative to said finger support areas by a distance sufficient to distribute loading forces substantially evenly between fingers of a user and said support ridge extends substantially horizontally.

14. The holder as defined in claim 13 wherein, said support ridge has a length sufficient to permit changing between gripping of said ridge with one finger and two fingers.

15. The holder as defined in claim 11 wherein, said open upwardly facing side of said body is dimensioned to receive a second holder of substantially the same configuration in nested relation thereto.

16. The holder as defined in claim 11, and restrictor means integral to at least one of said opposed ends for securing a carrying loop in said channel; and said restrictor means permitting insertion of said carrying loop into said restrictor means more easily than removal of said carrying loop from said restrictor means.

17. The holder as defined in claim 16 wherein, said side walls and said restrictor means are both slightly outwardly diverging to facilitate the stacking of one holder within another, and said side walls and restrictor means resisting relative longitudinal, transverse and rotational displacement between stacked holders.

18. The holder as defined in claim 17, and interlocking means provided on said body and formed for interlocking engagement between said holder and another holder when vertically stacked.

19. the holder as defined in claim 11 wherein, said channel is transversely dimensioned to receive and support a plurality of ribbon-like, bulky bag loops.

20. In a holder for attachment to a bag having one carrying loop, said holder including an elongated body terminating in opposed ends, said body having a substantially U-shaped transverse cross section providing an open upwardly facing loop receiving channel with upwardly facing loop support areas in said channel proximate said opposed ends, said body further having a relatively thin wall and downwardly facing finger support areas proximate said opposed ends in a downwardly facing manually engageable side of said body, the improvement in said holder comprising:

said body being formed with a downwardly protruding longitudinally extending stiffening ridge intermediate said finger support areas, said stiffening ridge being defined between an interior surface which is downwardly recessed between said loop support areas and an exterior surface which is substantially parallel and conforms closely to said interior surface, said exterior surface protruding downwardly between said finger support areas to provide a relatively thin body wall along said stiffening ridge having a sunstantially uniform wall thickness, said stiffening ridge providing both stiffening of said body against bending about a horizontal transverse axis intermediate said opposed ends and stiffening of said body against collapsing of side wall portions of said body toward each other about a horizontal longitudinal axis.

* * * * *

UNITED STATES PATENT AND TRADEMARK OFFICE

CERTIFICATE OF CORRECTION

PATENT NO. : 5,029,926

DATED : July 9, 1991

INVENTOR(S) : Peter D. Dieterich, Jr.

It is certified that error appears in the above-identified patent and that said Letters Patent is hereby corrected as shown below:

Col. 2, line 5, delete "finger" and insert ---fingers, and they tend to be rigid and do not---;

Col. 4, line 3, delete "elevational" and insert ---elevation---;

Col. 10, line 5, delete "H." and insert ---H,---;

Col. 12, line 15, delete "comsumer's" and insert ---consumer's---;

Col. 12, line 15, in second occurrence, delete "th" and insert ---the---.

Col. 12, line 47, Claim 1, insert -- and --after "therebetween"

Col. 13, line 39, Claim 10, delete "the" and insert ---The---;

Col. 14, line 1, Claim 12, delete "the" and insert ---The---;

Signed and Sealed this

Twenty-sixth Day of January, 1993

*Attest:*

STEPHEN G. KUNIN

*Attesting Officer*

*Acting Commissioner of Patents and Trademarks*